US008459574B2

(12) United States Patent
Achleitner et al.

(10) Patent No.: US 8,459,574 B2
(45) Date of Patent: Jun. 11, 2013

(54) VALVE AND NOZZLE DEVICE FOR THE INJECTION OF FUEL

(75) Inventors: Erwin Achleitner, Obertraubling (DE); Claus Anzinger, Neutraubling (DE); Willibald Schürz, Pielenhofen (DE)

(73) Assignee: Continental Automotive GmbH, Hannover (DE)

( * ) Notice: Subject to any disclaimer, the term of this patent is extended or adjusted under 35 U.S.C. 154(b) by 477 days.

(21) Appl. No.: 11/264,975

(22) Filed: Nov. 2, 2005

(65) Prior Publication Data

US 2006/0091240 A1 May 4, 2006

(30) Foreign Application Priority Data

Nov. 4, 2004 (DE) ..... 10 2004 053 350

(51) Int. Cl.

| | |
|---|---|
| ***B05B 1/26*** | (2006.01) |
| ***B05B 1/30*** | (2006.01) |
| ***F02M 61/00*** | (2006.01) |
| ***F02M 61/10*** | (2006.01) |

(52) U.S. Cl.

USPC ..... 239/533.12; 239/518; 239/533.11; 239/533.13; 239/584

(58) Field of Classification Search

USPC ..... 239/533.7, 533.11, 533.12, 533.13, 239/584, 518

See application file for complete search history.

(56) References Cited

U.S. PATENT DOCUMENTS

| | | | | |
|---|---|---|---|---|
| 4,417,694 | A | 11/1983 | Claxton et al. | 239/533.12 |
| 4,759,335 | A * | 7/1988 | Ragg et al. | 123/531 |
| 4,817,873 | A * | 4/1989 | McKay | 239/397.5 |
| 5,593,095 | A * | 1/1997 | Davis et al. | 239/584 |
| 6,612,508 | B2 * | 9/2003 | Lambert | 239/533.12 |
| 2004/0021015 | A1 * | 2/2004 | Murdoch | 239/533.12 |

FOREIGN PATENT DOCUMENTS

| | | |
|---|---|---|
| GB | 191403694 | 0/1915 |
| GB | 2080416 A | 2/1982 |
| GB | 2255802 A | 11/1992 |
| WO | 03/038271 A1 | 5/2003 |

OTHER PUBLICATIONS

European Patent Search Report and Office Action from EP 05 10 9378.9 (6 Pages), Dec. 6, 2005.

* cited by examiner

*Primary Examiner* — Ryan Reis
(74) *Attorney, Agent, or Firm* — King & Spalding L.L.P.

(57) ABSTRACT

A valve for the injection of fuel has a valve body (4) which has a recess (5) in which a valve needle (6) that is movable in the axial direction is arranged. The valve needle (6) together with the valve body (4) forms an injection nozzle (7) in a downstream zone. In a closed position the valve needle (6) prevents a stream of fuel from passing through the injection nozzle (7) but otherwise leaves it unimpeded. At a downstream end the injection nozzle (7) has a deflecting element (20) so arranged that a stream of fuel is deflected from taking a predominantly upstream course from the deflecting element (20).

19 Claims, 3 Drawing Sheets

VALVE AND NOZZLE DEVICE FOR THE INJECTION OF FUEL

CROSS-REFERENCE TO RELATED APPLICATIONS

This application claims priority from German Patent Application No. 10 2004 053 350.4, which was filed on Nov. 4, 2004, and is incorporated herein by reference in its entirety.

TECHNICAL FIELD

The invention relates to a valve for the injection of fuel, the valve having a valve body with a recess in which a valve needle that is movable in the axial direction is arranged, the valve needle together with the valve body forming an injection nozzle in a downstream zone. The invention further relates to a nozzle device for the injection of fuel having a nozzle head in which an injection nozzle is formed in a downstream zone.

SUMMARY

The object of the invention is to create a valve and a nozzle device in which the spray pattern of the injected fuel is permanently protected from alterations due to fouling.

This object can be achieved by means of a valve for the injection of fuel comprising a valve body with a recess in which a valve needle that is movable in the axial direction is arranged, the valve needle together with the valve body forming an injection nozzle in a downstream zone, and in a closed position preventing a stream of fuel from passing through the injection nozzle but otherwise leaving it unimpeded, while the injection nozzle has a deflecting element at a downstream end, so arranged that a stream of fuel is deflected from taking a predominantly upstream course from the deflecting element.

The recess can widen conically or spherically in the downstream zone in the direction of flow as far as a first edge and at a downstream end the valve needle has a closing body which widens conically or spherically in the direction of flow as far as a second edge, and in the closed position the closing body sits on the recess wall in the downstream zone of the valve body. The second edge can be arranged downstream of the first edge. The deflecting element can be formed in a zone adjacent to the second edge. The deflecting element can be formed in one piece with the valve needle. The deflecting element can be applied in the form of a coating.

The object can also be achieved by a nozzle device for the injection of fuel, comprising a nozzle head in which an injection nozzle is formed in a downstream zone, the injection nozzle comprising a deflecting element so arranged that a stream of fuel is deflected from taking a predominantly upstream course from the deflecting element.

The invention is firstly distinguished by a valve for the injection of fuel, the valve having a valve body with a recess in which a valve needle that is movable in the axial direction is arranged. The valve needle together with the valve body forms an injection nozzle in a downstream zone. In a closed position the valve needle prevents the stream of fuel from passing through the injection nozzle but otherwise leaves it unimpeded. At a downstream end the injection nozzle has a deflecting element so arranged that a stream of fuel is deflected from taking a predominantly upstream course from the deflecting element. The deflecting element can be formed on the valve body or on the valve needle. The injection nozzle includes a gap which is provided between the valve body and the valve needle in the downstream zone. The fuel can be gaseous or liquid.

The invention is based on the finding that when an engine is running, deposits form on those areas of a valve which are subjected to hot combustion gases and which the stream of fuel does not flow into at a high velocity. At high temperatures these deposits, consisting mainly of carbon, can result from the carbonization of fuel residues on the injection nozzle or from fouling by combustion residues from the combustion gases. These deposits can increase so far that they extend into the stream of fuel, deflecting the stream of fuel from the predominantly upstream direction in an undesirable way. This can disadvantageously alter the spray pattern of the valve.

The stream of fuel flows onto the deflecting element at a high rate of flow, enabling this high flow rate of the stream of fuel to wash off any combustion residues or early signs of carbonization deposited on the deflecting element. This is especially the case if the deflecting element is arranged and designed in the same way as deposits that would arise if the deflecting element were not provided. A force exercised by the stream of fuel on a deposit is then greater than the adhesion force of the deposits themselves. The deflecting element therefore acts as an artificial deposit or carbonization, corresponding to an artificial aging of the valve with regard to deposits or carbonization.

The deflecting element is intended to change the spray pattern of the injected fuel in the same way that deposits and carbonization on the injection nozzle change the spray pattern after a lengthy service life. By providing the deflecting element and taking the deflection of the stream of fuel into account by suitably adjusting the geometry of the injection nozzle, the fuel can permanently be injected without any alteration in the spray pattern due to further deposits.

In an advantageous embodiment of the valve, the recess in the downstream zone widens conically or spherically in the direction of flow as far as a first edge. At a downstream end, the valve needle has a closing body which widens conically or spherically in the direction of flow as far as a second edge. In the closed position the closing body sits on the recess wall in the downstream zone of the valve body. Such a valve enables a uniform, internally tapered spray pattern through an externally opening valve. This spray pattern is advantageous for good combustion of the fuel, that is, complete combustion of the fuel giving clean exhaust.

In this connection it is advantageous if the second edge is arranged downstream of the first edge. It has been shown that this is particularly advantageous for good fuel combustion.

In a further advantageous embodiment of the valve, the deflecting element is formed in a zone adjacent to the second edge. This has the advantage that the valve needle is then easy and cost-effective to manufacture.

In a further advantageous embodiment of the valve, the deflecting element is formed in one piece with the valve needle. This makes the deflecting element particularly durable, since the valve needle is preferably made of steel.

In a further advantageous embodiment of the valve, the deflecting element is applied in the form of a coating. This has the advantage that such a coating is particularly easy and cost-effective to manufacture.

The invention is secondly distinguished by a nozzle device for the injection of fuel having a nozzle head in which an injection nozzle is formed in a downstream zone. The injection nozzle has a deflecting element so arranged that a stream of fuel is deflected from taking a predominantly upstream course from the deflecting element. Such a nozzle device has advantages and suitable embodiment options, depending on the valve.

BRIEF DESCRIPTION OF THE DRAWINGS

Typical embodiments of the invention are explained below with the aid of the attached diagrams.

Elements which have the same design or function are given the same reference characters in all the figures.

DETAILED DESCRIPTION

Figure 1:
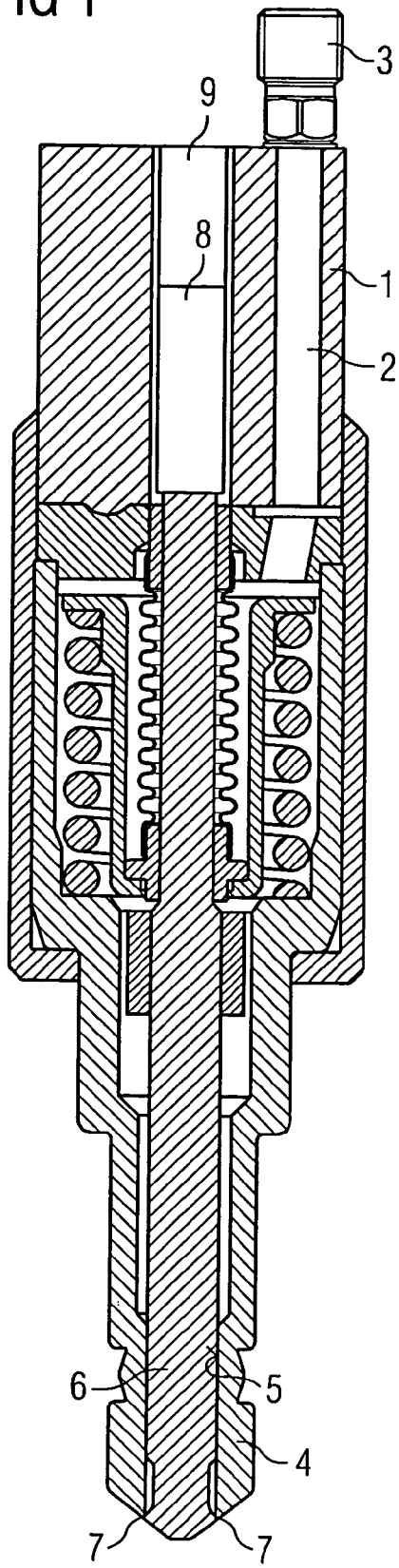
FIG. 1 shows a valve.

FIG. 1 shows a valve for the injection of fuel, particularly for the injection of fuel in motor vehicle internal combustion engines. The valve has an injector housing 1 in which a drill hole 2 is formed, and a connection 3 which is coupled to the drill hole 2 and through which fuel can be fed to the valve. The valve further includes a valve body 4 with a recess 5 in which a valve needle 6 that is movable in the axial direction is arranged, and in a closed position the valve needle closes an injection nozzle 7 but otherwise allows a stream of fuel to pass through the injection nozzle 7. The valve further includes a lifting device having an actuator 8 and a compensating element 9 coupled together in the axial direction. The actuator 8 may be a piezoactuator, for example. The displacement of the lifting device is dependent on the axial extent of the actuator 8, the extent being dependent on a corrective signal. The lifting device is coupled to the valve needle 6 and works in conjunction with the valve needle 6 in such a way that the displacement of the lifting device is transmitted to the valve needle 6 so that the valve needle 6 is moved to its closed position or to an open position.

Figure 2:
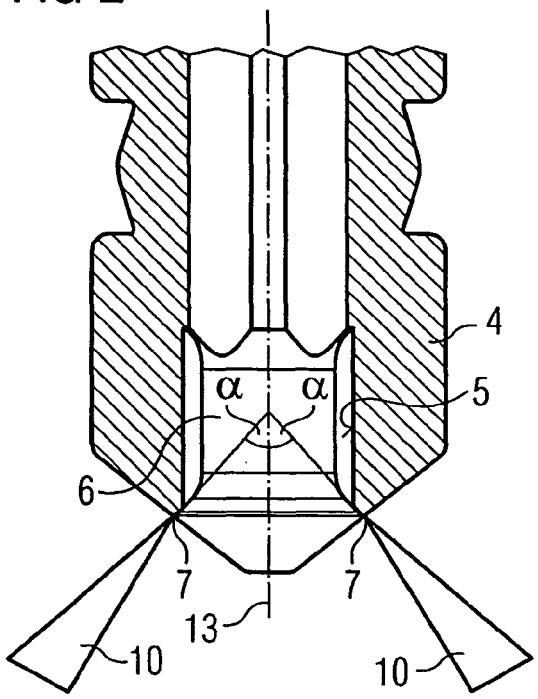
FIG. 2 shows a downstream zone of the valve according to FIG. 1.
Figure 3:
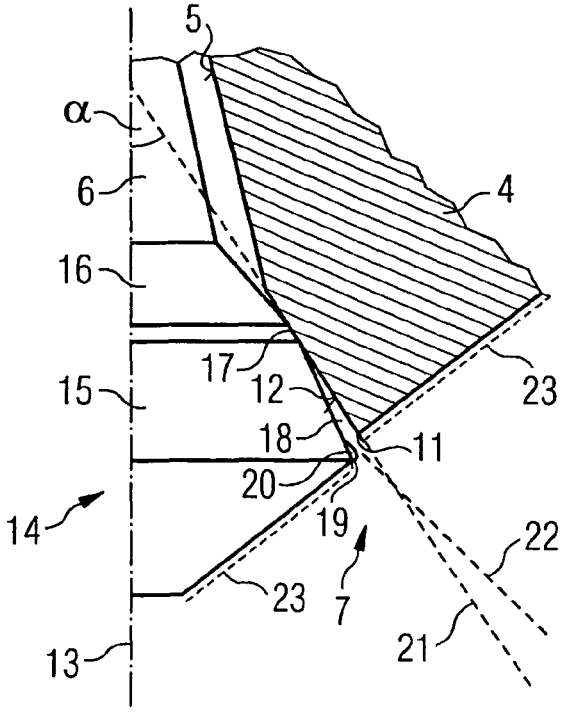
FIG. 3 shows an enlarged section of the downstream zone of the valve according to FIG. 2.

FIG. 2 shows a downstream zone of the valve with an internally tapered spray pattern 10. FIG. 3 shows an enlarged section of the downstream zone of the valve according to FIG. 2. The recess 5 in the valve body 4 widens conically in a downstream zone of the valve body 4 as far as a first edge 11, forming an internal taper 12 of the valve body 4. The internal taper 12 of the valve body 4 has a setting angle $\alpha$ relative to a longitudinal axis 13 of the recess 5.

At its downstream end, the valve needle 6 has a closing body 14 having a first taper 15 and a second taper 16. A setting angle of the first taper 15 is somewhat smaller than the setting angle $\alpha$ of the internal taper 12 of the valve body 4 and a setting angle of the second taper 16 is somewhat larger than the setting angle $\alpha$ of the internal taper 12 of the valve body 4. The setting angles of the first taper 15 and the second taper 16 are also relative to the longitudinal axis 13 of the recess 5 as in the case of the setting angle $\alpha$.

In the closed position of the valve, the closing body 14, having a transition zone between the first taper 15 and the second taper 16, sits on the internal taper 12 of the valve body 4, forming a valve seat 17. The transition zone between the first taper 15 and the second taper 16 may be rounded, or have a further taper with a setting angle which is preferably approximately the same as for instance the setting angle $\alpha$ of the internal taper 12 of the valve body 4. Likewise the first taper 15 and the second taper 16 can be immediately adjacent to one another. This ensures that even in the case of unavoidable tolerances due to the manufacturing process of the internal taper 12 of the valve body 4, the first taper 15 or the second taper 16, when the valve is in the closed position the valve reliably obstructs the stream of fuel. Due to the different setting angles of the first taper 15 and the setting angle $\alpha$ of the internal taper 12 of the valve body 4, a gap 18 is formed downstream of the valve seat 17 between the first taper 15 and the internal taper 12 of the valve body 4. The internal taper 12 of the valve body 4, the first taper 15, the second taper 16 and the transition zone, together form the injection nozzle 7.

The first taper 15 extends as far as a second edge 19 at a downstream end of the injection nozzle 7. In the closed position of the valve needle 6, the second edge 19 is preferably further from the valve seat 17 than the first edge 11 of the valve body 4. It has been shown that this has an advantageous effect on the spray pattern 10 and is therefore able to improve combustion. It has also been shown however that when the valve is operating deposits occur in a zone of the second edge 19, being formed from fuel residues in the gap 18 or because of fouling by combustion residues in the combustion gases due to high temperatures during combustion of the fuel. These deposits are also known as carbonization or coking. Coking in the downstream end of the injection nozzle 7 can cause a situation in which the stream of fuel issuing from the injection nozzle 7 is deflected from its predominantly upstream direction and thus alters the spray pattern 10 in an undesirable way.

A deflecting element 20 is provided at the downstream end of the injection nozzle 7 in order to prevent undesirable alteration of the spray pattern 10 due to coking. The deflecting element 20 preferably deflects the stream of fuel in the same way as the coking which would be formed in this zone after a lengthy service life if the deflecting element 20 were not provided. The deflecting element 20 therefore equates to an artificial coking or an artificial aging with regard to the coking of the valve. By additionally adapting the valve body 4 and the closing body 14 of the valve needle 6, the spray pattern 10 can be formed into any desired shape and permanently protected from the undesirable alterations brought about by coking.

The deflecting element 20 alters the direction of flow of the stream of fuel from a first direction of flow 21 which would occur in the case of an equivalent valve without a deflecting element 20 and without any coking, into a second direction of flow 22 of the stream of fuel. By changing the setting angle $\alpha$ the direction of flow of the stream of fuel can be corrected accordingly, in this typical embodiment by reducing the setting angle $\alpha$ by an angle by which the stream of fuel is deflected by the deflecting element 20 from taking a predominantly upstream course from the deflecting element 20. The setting angles of the first taper 15 and of the second taper 16 are corrected accordingly.

The deflecting element 20 is arranged and shaped in such a way that deposits building up in the zone which the stream of fuel flows into are washed away from the deflecting element 20 during subsequent injection procedures, since the deflecting element 20 preferably extends into an area of the fuel stream in which a suitably high rate of flow predominates.

The deflecting element 20 can be formed in one piece with the valve needle 6. Preferably however the deflecting element 20 is designed as a coating 23 which can extend as far as an external zone of the valve body 4 or valve needle 6. Such a coating is very easy and cost-effective to manufacture. The coating 23 can be applied in the form of a layer of carbon, for example. The coating 23 can also be manufactured from other suitable materials, in particular those that withstand the high temperatures during combustion. The coating 23 can also be applied only to the downstream end of the injection nozzle 7 to form the deflecting element 20.

The internal taper 12 of the valve body 4 or the closing body 14 in a zone of the first taper 15, the second taper 16 and the transition zone, can also be spherical in shape. The deflecting element 20 can also be arranged at a downstream end of the internal taper 12 of the valve body 4.

Figure 4:
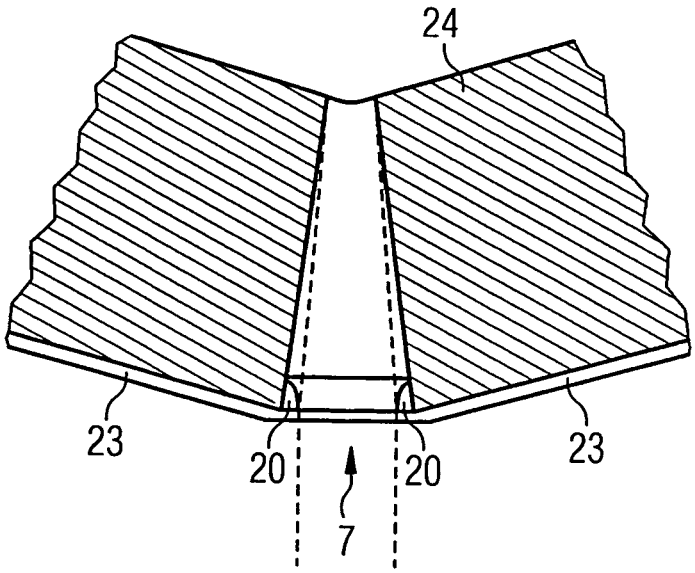
FIG. 4 shows a nozzle device.

FIG. 4 shows a nozzle device having a nozzle head 24 in which an injection nozzle 7 is formed. The deflecting element 20 is arranged at the downstream end of the injection nozzle 7. The deflecting element 20 can be formed in one piece with the nozzle head 24 or be produced by the coating 23 on the nozzle head 24. The nozzle device can also be formed of a plurality of pieces, so that the injection nozzle 7 is formed by further components.

The deflecting element 20 on the injection nozzle 7 can ensure, both when the valve or nozzle device is new and when the valve or nozzle device has had a lengthy service life, that the shape of the spray pattern 10 is not only as desired but also promotes economical combustion.

What is claimed is:

1. A valve for the injection of fuel comprising a valve body with a recess in which a valve needle that is movable in the axial direction is arranged, said valve needle together with the valve body forming an injection nozzle in a downstream zone wherein the injection nozzle in a closed position prevents a stream of fuel from passing through the injection nozzle, wherein the valve body has a conical portion defining a conical inner surface that is tapered with respect to a longitudinal axis of the valve needle by a setting angle, wherein said valve needle comprises a closing body including:

a first conical portion having an outer surface defining a first conical outer surface being tapered with respect to the longitudinal axis by an angle less than the setting angle of the conical inner surface of the valve body, and a second conical portion having an outer surface defining a second conical outer surface being tapered with respect to the longitudinal axis by an angle greater than the setting angle of the conical inner surface of the valve body, wherein a transition between the first and second conical outer surfaces of the valve needle closing body defines a valve seat configured to contact the inner conical surface of the valve body in a closing position of the closing body, wherein a fuel communicating gap downstream of the valve seat is defined between the first conical outer surface of the closing body and the conical inner surface of the valve body, the first conical outer surface and the conical inner surface extending from the valve seat in the downstream direction, wherein a deflecting element is formed at a downstream end of either the first conical outer surface of the closing body or the conical inner surface of the valve body, the deflecting element extending from said first outer surface of the closing body or said conical inner surface of the valve body into an area of the stream of fuel so arranged that a stream of fuel is deflected, wherein the deflecting element has a shape corresponding to an artificial deposit of residue or carbonization, and the geometry of the deflecting element creating a high flow rate against the deflecting element, thus reducing actual deposit of residue or carbonization in the area of the deflecting element.

2. A valve according to claim 1, wherein the deflection element has a non-linear cross-section that corresponds to the shape of an artificial deposit of residue or carbonization.

3. A valve according to claim 2, wherein the cross section of the deflecting element is drop-shaped.

4. A valve according to claim 2, wherein the deflecting element is formed on said surface in a zone adjacent to an edge of the first outer surface of the closing body in downstream direction.

5. A valve according to claim 1, wherein the deflecting element is formed in one piece with the valve needle.

6. A valve according to claim 1, wherein the deflecting element is applied in the form of a coating.

7. A nozzle device for the injection of fuel, comprising a nozzle head in which an injection nozzle is formed in a downstream zone, said injection nozzle comprising:

a fuel communicating gap defined between a valve body having a conical inner surface and a valve needle closing body having a first conical portion and a second conical portion, the fuel communicating gap defining:

a first gap portion defined between the conical inner surface of the valve body and a first conical outer surface of the first conical portion of the valve needle closing body, wherein a width of the first gap increases continuously and uniformly in the downstream direction towards the deflecting element, a second gap portion defined between the conical inner surface of the valve body and a second conical outer surface of the second conical portion of the valve needle closing body, wherein a width of the second gap decreases continuously and uniformly in the downstream direction; and a deflecting element extending from said first conical outer surface of the first conical portion of the valve needle closing body in a direction across the first gap portion of the fuel communicating gap and into an area of a stream of fuel and so arranged that the stream of fuel is deflected, wherein the deflecting element has a shape corresponding to as an artificial deposit of residue or carbonization and the deflecting element has a drop-shaped cross section creating a high flow rate against the deflecting element, thus reducing actual deposit of residue or carbonization in the area of the deflecting element, wherein the deflecting element is a coating on the nozzle head.

8. A nozzle device according to claim 7, wherein the deflecting element is arranged at a downstream end of the injection nozzle.

9. A nozzle device according to claim 7, wherein the nozzle device comprises a plurality of pieces.

10. A valve for the injection of fuel comprising:

a valve body having a conical portion defining a conical inner surface that is tapered with respect to a longitudinal axis of the valve needle by a setting angle, a valve needle that is movable in the axial direction arranged in the recess, wherein (a) the valve needle together with the valve body form an injection nozzle in a downstream zone, and in a closed position prevent a stream of fuel from passing through the injection nozzle, (b) the valve needle comprising a closing body including (i) a first conical portion having an outer surface defining a first conical outer surface being tapered with respect to the longitudinal axis by an angle less than the setting angle of the conical inner surface of the valve body, and (ii) a second conical portion having an outer surface defining a second conical outer surface being tapered with respect to the longitudinal axis by an angle greater than the setting angle of the conical inner surface of the valve body, wherein a transition between the first and second conical outer surfaces of the valve needle closing body defines a valve seat that contacts the valve body in the closed position, (c) a fuel communicating gap is defined between the valve body and the valve needle closing body when said valve seat of said valve needle closing body is in contact with said valve body, and a deflecting element having a drop-shaped cross section extending from either the first conical outer surface of the valve needle closing body or the conical inner surface of the valve body in a direction across the gap between the valve body and the valve needle closing body at a downstream end of the valve needle closing body, and wherein the deflecting element is configured to act as an artificial deposit of residue or carbonization, and the cross-section of the deflecting element creating a high flow rate against the deflecting element, thus reducing actual deposit of residue or carbonization in the area of the deflecting element.

11. A valve according to claim 10, wherein the deflecting element is formed in one piece with the valve needle.

12. A valve according to claim 10, wherein the deflecting element is applied in the form of a coating.

13. A valve for the injection of fuel comprising:

a valve body having a conical portion defining a conical inner surface that is tapered with respect to a longitudinal axis of the valve needle by a setting angle, a valve needle that is movable in the axial direction arranged in the recess, wherein the valve needle together with the valve body form an injection nozzle in a downstream zone, and in a closed position prevent a stream of fuel from passing through the injection nozzle, wherein the valve needle has a closing body comprising a closing body including (i) a first conical portion having an outer surface defining a first conical outer surface being tapered with respect to the longitudinal axis by an angle less than the setting angle of the conical inner surface of the valve body, and (ii) a second conical portion having an outer surface defining a second conical outer surface being tapered with respect to the longitudinal axis by an angle greater than the setting angle of the conical inner surface of the valve body, wherein a transition between the first and second conical outer surfaces of the closing body defines a valve seat configured to contact the conical inner surface of the valve body, the closing body defining a fuel communicating gap between the conical inner surface of the valve body and the first and second conical outer surfaces of the valve needle closing body, and a deflecting element having a drop-shaped cross section and being arranged in the fuel communicating gap and extending from the conical inner surface of the valve body or from the first conical outer surface of the valve needle closing body in a direction across the fuel communicating gap such that a stream of fuel is deflected from a downstream course, and wherein the deflecting element is configured to act as an artificial deposit of residue or carbonization, and the geometry of the deflecting element creating a high flow rate against the deflecting element, thus reducing actual deposit of residue or carbonization in the area of the deflecting element.

14. A valve according to claim 13, wherein the deflecting element is formed in one piece with the valve needle.

15. A valve according to claim 13, wherein the deflecting element is applied in the form of a coating.

16. A valve according to claim 13, wherein the closing body extends beyond the valve body and wherein the deflecting element is arranged such that it extends beyond the valve body.

17. A valve according to claim 1, wherein the deflecting element is a coating that partially covers the first conical outer surface and represents a protrusion on the first conical outer surface extending radially outwards from the first conical outer surface.

18. A valve according to claim 1, wherein the deflecting element is a coating that partially covers the first conical inner surface of the valve body and represents a protrusion on the conical inner surface extending radially inwards from the conical inner surface.

19. A valve according to claim 1, wherein the deflecting element is a coating formed on the valve body.

* * * * *